US007360926B2

(12) United States Patent
Lee

(10) Patent No.: US 7,360,926 B2
(45) Date of Patent: Apr. 22, 2008

(54) FLASH ADORNMENT STRUCTURE

(76) Inventor: Ching-Hui Lee, No. 4, Turnpike Right Side, Yishan Village, Shrling Township, Huadu District, Guangzhou City, Guangdong Province (CN)

( * ) Notice: Subject to any disclaimer, the term of this patent is extended or adjusted under 35 U.S.C. 154(b) by 69 days.

(21) Appl. No.: 11/385,778

(22) Filed: Mar. 22, 2006

(65) Prior Publication Data

US 2007/0223223 A1 Sep. 27, 2007

(51) Int. Cl.
*F21V 21/00* (2006.01)

(52) U.S. Cl. ..... 362/249; 362/104; 362/194; 362/202; 362/251

(58) Field of Classification Search ..... 362/249, 362/199, 251, 104, 116, 194, 196, 200, 202, 362/208, 235, 172, 173, 362, 806, 203, 204, 362/800

See application file for complete search history.

(56) References Cited

U.S. PATENT DOCUMENTS 5,428,484 A * 6/1995 Baker ..... 359/872
5,475,368 A * 12/1995 Collins ..... 340/574
6,857,756 B2 * 2/2005 Reiff et al. ..... 362/184
6,953,260 B1 * 10/2005 Allen ..... 362/194
7,147,345 B1 * 12/2006 Toney, Jr. ..... 362/208

* cited by examiner

*Primary Examiner*—Sharon E. Payne
*Assistant Examiner*—Mark Tsidulko
(74) *Attorney, Agent, or Firm*—Rosenberg, Klein & Lee

(57) ABSTRACT

A flash adornment includes a base, a shining mechanism held in the base, and an upper lid secured over the base; the base has several connecting holes near to the edge; the shining mechanism includes a circuit board, and light emitting elements; the circuit board has through holes facing respective connecting holes of the base; the upper lid has a hollowness, over which a transparent protective cover is secured; the upper lid has several fixing parts and posts on an edge of an inner side; each fixing part has a fitting room therein, which holds a respective one of the light emitting elements; the posts each have a hole, and they are passed through respective ones of the through holes of the circuit board; screws are passed through the connecting holes and into the holes of the posts to secure the upper lid to the base.

15 Claims, 4 Drawing Sheets

FLASH ADORNMENT STRUCTURE

BACKGROUND OF THE INVENTION

1. Field of the Invention

The present invention relates to a flash adornment, more particularly one, which has such a fixing structure that a shining mechanism can be easily secured between a base and an upper lid thereof.

2. Brief Description of the Prior Art

Shining adornments are usually available for sale or given to participants in activities such as concerts, festivals, and dance parties. Such shining adornments are usually in the shape of a stick; thus, the participants can wave the shining adornments to produce novel and dazzlingly beautiful lighting in the scene.

However, the users have to hold such stick-shaped shining adornments all the time. In other words, there is no other way to use the stick-shaped shining adornments. Furthermore, such stick-shaped shining adornments are either coated with luminous agents or electrically powered to produce monotonous lighting. Therefore, there is a lack of variety and amusingness to use such stick-shaped shining adornments.

Therefore, it is a main object of the present invention to provide a flash adornment, which is more novel and produces more amusingness.

SUMMARY OF THE INVENTION

The flash adornment of the present invention includes a base, a shining mechanism held in the base, and an upper lid secured over the base. The base has several connecting holes near to the edge. The shining mechanism includes a circuit board, and light emitting elements. The circuit board has through holes facing respective of the connecting holes of the base. The upper lid has several fixing parts and posts on an edge of an inner side thereof, and has a hollowness, over which a transparent protective cover is secured; each of the fixing parts has a fitting room therein, which holds a respective one of the light emitting elements; the posts each have a hole, and they are passed through respective ones of the through holes of the circuit board; screws are passed through the connecting holes of the base and into the holes of the posts to secure the upper lid to the base.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
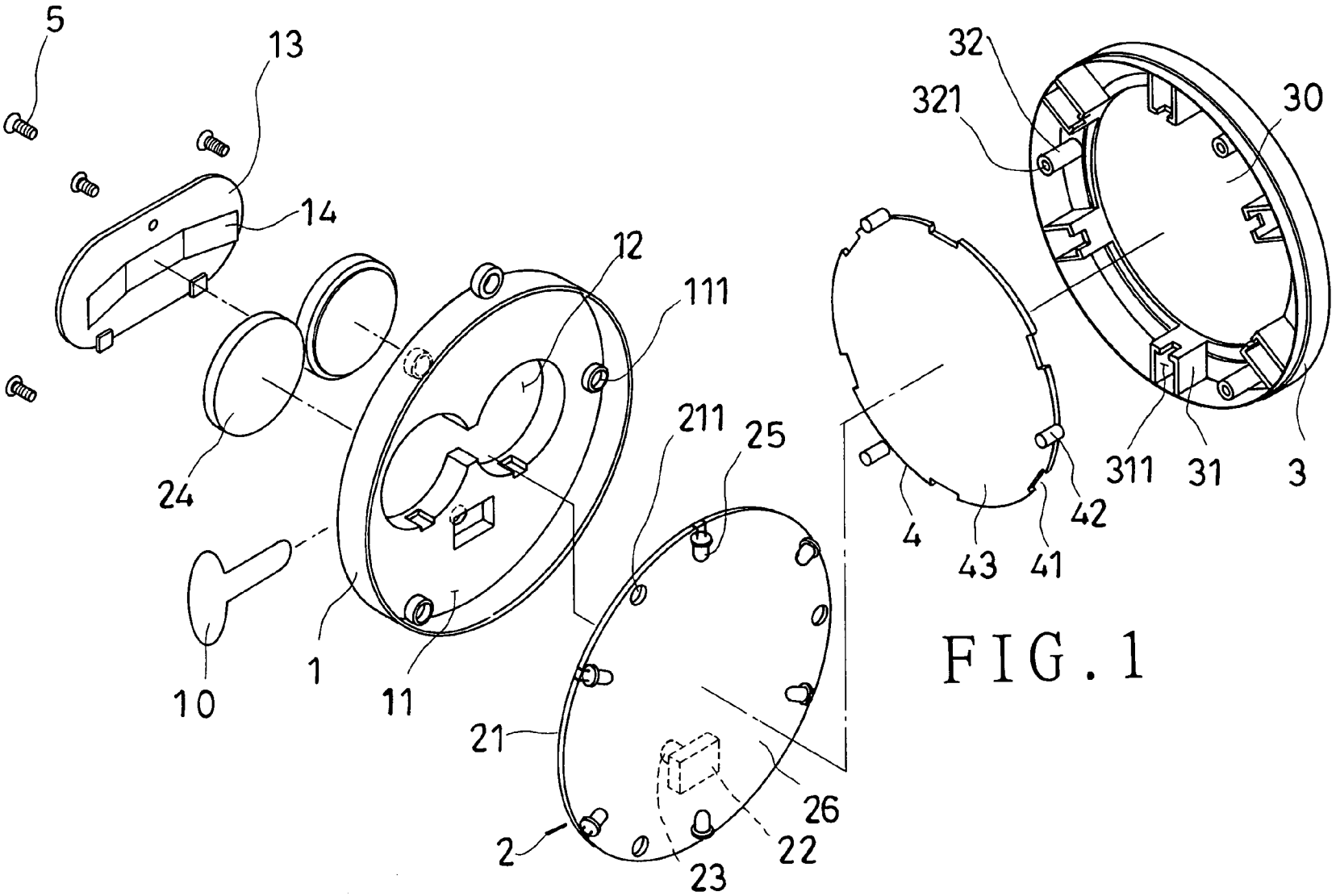
FIG. 1 is an exploded perspective view of the present invention.
Figure 2:
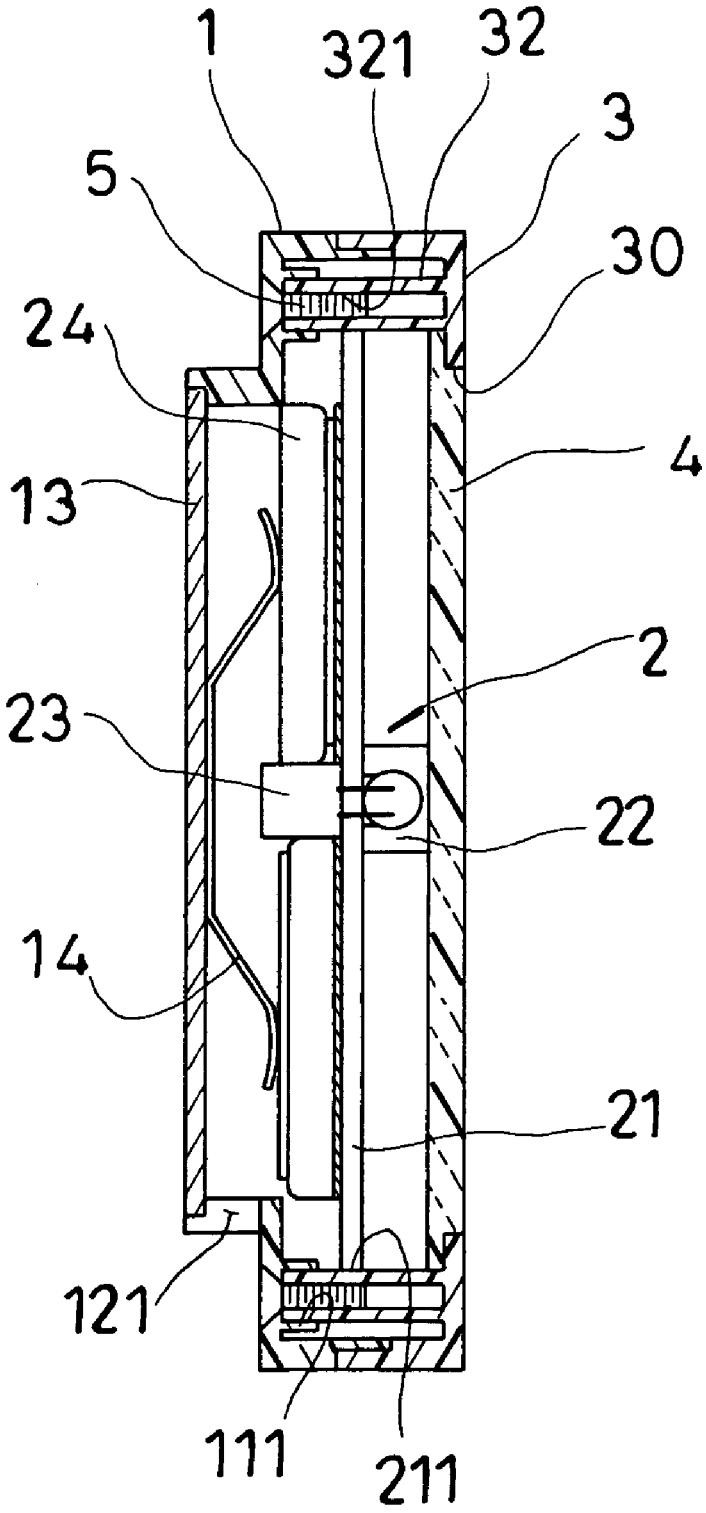
FIG. 2 is a lateral sectional view of the present invention (1)
Figure 3:
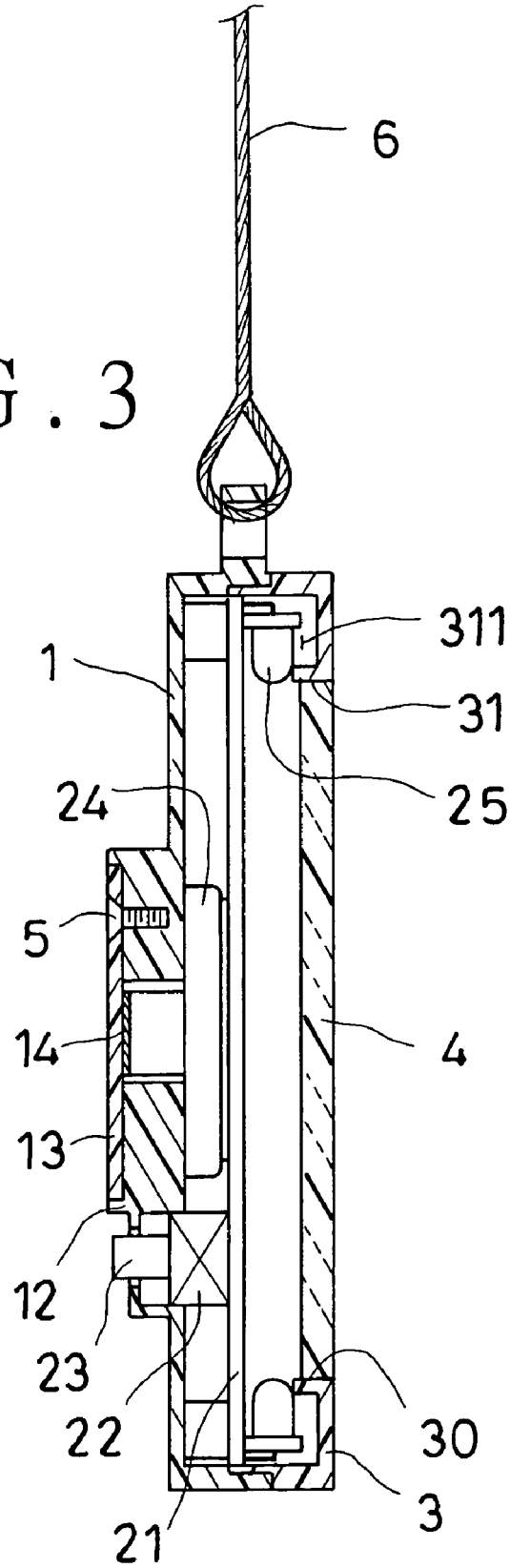
FIG. 3 is a lateral sectional view of the present invention (2)

Referring to FIGS. 3 to 8, a preferred embodiment of a flash adornment of the present invention includes:

a round base 1, the round base 1 has a holding room 11 therein, several connecting holes 111 near to an edge of a lower portion of the holding room 11, a battery holding portion 12 adjacent to a bottom of the holding room 11, an opening 121 on a circumferential side thereof, a battery covering 13 secured over the battery holding portion 12, and an electricity conducting plate 14 secured on an inner side of the battery covering 13; the opening 121 communicates with the battery holding portion 12;

a shining mechanism 2 held in the holding room 11 of the round base 1, the shining mechanism 2 includes a circuit board 21, a control unit 22, a switch 23, batteries 24, and several light emitting elements 25; the circuit board 21 is coated with reflecting agents on an upper side thereof, and it has several through holes 211 near to an edge thereof, which face respective ones of the connecting holes 111 of the round base 1; the control unit 22 has programs therein, and it is connected to a lower side of the circuit board 21; the switch 23 is connected to the control unit 22, and sticks out from the round base 1; the batteries 24 are connected to the circuit board 21, and held in the battery holding portion 12 of the round base 1; the light emitting elements 25 are positioned on an edge of the upper side of the circuit board 21 and connected to the circuit board 21;

an upper lid 3 secured over an upper end of the round base 1, the upper lid 3 has a hollowness 30, several spaced apart fixing parts 31 and several post parts 32 on an edge of an inner side thereof; each of the fixing parts 31 has a fitting room 311 therein; the post parts 32 each have an axial hole 321, and they are passed through respective ones of the through holes 211 of the circuit board 21 and into the connecting holes 111 of the round base 1; and a transparent protective cover 4 secured over the hollowness 30 of the upper lid 3, the transparent protective cover 4 has several spaced apart gaps 41 on an edge thereof, several propping posts 42 on an edge of an inward side thereof, and a layer of drawings 43 thereon; the fixing parts 31 of the upper lid 3 are fitted in respective ones of the gaps 41, and the light emitting elements 25 are held in respective ones of the fitting rooms 311 of the fixing parts 31; the propping posts 42 are pressed against the circuit board 21; furthermore, screws 5 are passed through the connecting holes 111 of the round base 1 and into the axial holes 321 of the post parts 32 of the upper lid 3 while a hanging string 6 is connected to the round base 1.

In assembly, the transparent protective cover 4 is joined to the upper lid 3 with the fixing parts 31 being fitted in the gaps 41, and the circuit board 21 of the shining mechanism 2 is positioned on the upper lid 3 with the light emitting elements 25 being held in the fitting rooms 311 of the fixing parts 31, and with the post parts 32 being passed through the through holes 211, and with the propping posts 42 of the transparent protective cover 4 being pressed against the circuit board 21. Next, the round base 1 is joined to the upper lid 3 with the post parts 31 being passed into respective ones of the connecting holes 111, and the screws 5 are passed through the connecting holes 111 and into the axial holes 321 of the post parts 32 to secure the round base 1 and the upper lid 3 together; thus, the shining mechanism 2 is secured between the round base 1 and the upper lid 3. Next, the batteries 24 are positioned in the battery holding portion 12 of the round base 1 so as to be electrically connected to the circuit board 21. And, the battery covering 13 is secured over the battery holding portion 12 for electrically connecting the conducting plate 14 to the batteries 24.

The light emitting elements 25 can be turned on and off by means of pressing the switch 23; when the switch 23 is switched to ON position, the circuit will be closed, which includes the batteries 24, the light emitting elements 25, and the control unit 22, and the control unit 22 with programs will make the light emitting elements 25 flash on and off repeatedly in different manners, at different time points and with different frequencies; thus, dynamic images are produced. The reflecting agents 26 will reflect light emitting from the light emitting elements 35 to increase brightness. And, the drawings 43 on the transparent protective cover 4 will make the flash adornment of the present invention more novel and dazzlingly beautiful. And, the user is allowed to hang the flash adornment around his/her neck.

Figure 4:
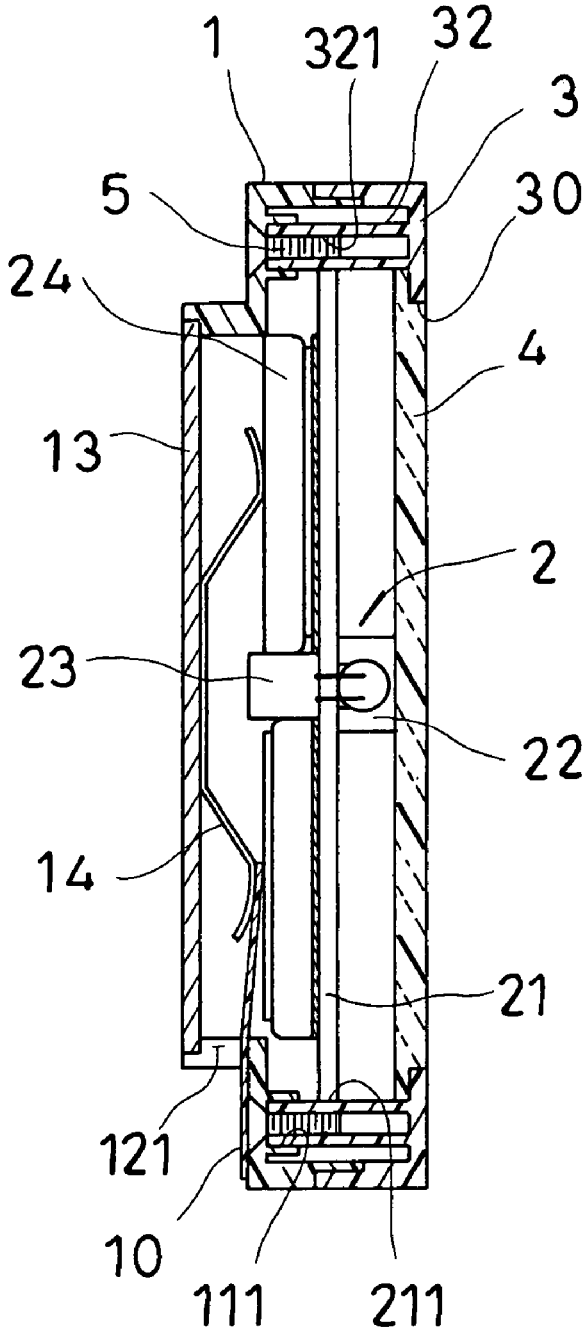
FIG. 4 is a lateral sectional view of the present invention (3).

Furthermore, the user is allowed to insert an insulating plate 10 between the batteries 24 and the electricity conducting plate 14 of the battery covering 13 through the opening 121 so as to break the circuit, as shown in FIG. 4; thus, the light emitting elements 25 can't be accidentally activated to waste power of the batteries 24 when the flash adornment is not-in-use or in transportation.

From the above description, it can be easily seen that the present invention has the following advantages:

1. The shining mechanism is firmly held between the upper lid and the round base by means of the post parts and the fixing parts of the upper lid, which are relatively easy to form, and don't complicate the structure of the present invention.

2. The control unit with programs will make the light emitting elements flash on and off repeatedly in different manners, at different time points and with different frequencies so as to produce dynamic images. Consequently, the flash adornment of the present invention looks novel and dazzlingly beautiful.

3. The drawings on the transparent protective cover can be made in such a way as to match the subject of an activity, and in turn value and commemorative meaning of the flash adornment increase.

4. The user is allowed to hang the flash adornment around his neck when waving other stick-shaped adornments in an activity.

5. The flash adornment will shine more brightly because the circuit board is coated with reflecting agents.

6. The light emitting elements can be prevented from being accidentally activated to waste power of the batteries by means of inserting the insulating plate between the batteries and the electricity conducting plate of the battery covering through the opening of the round base.

What is claimed is:

1. A flash adornment structure, comprising:

(a) a base, the base has a holding room therein, and a plurality of connecting holes near to an edge of a lower portion of the holding room;

(b) a shining mechanism held in the holding room of the base, the shining mechanism including:

a circuit board, the circuit board having a plurality of through holes near to an edge thereof; said through holes facing respective ones of the connecting holes of the base; and a plurality of light emitting elements on a first side of the circuit board;

(c) an upper lid secured over the base, the upper lid having a hollowness; the upper lid having a plurality of spaced apart fixing parts and a plurality of post parts on an edge of an inner side thereof each of the fixing parts having a fitting room therein, which holds a respective one of the light emitting elements; each of the post parts having a hole; the post parts being passed through respective ones of the through holes of the circuit board; screws being passed through the connecting holes of the base and into the holes of the post parts to secure the base to the upper lid; and (d) a transparent protective cover secured over the hollowness of the upper lid , the transparent protective cover having a plurality of spaced apart gaps on an edge thereof in which the fixing parts of the upper lid are fitted.

2. The flash adornment structure as recited in claim 1, wherein the shining mechanism has a control unit containing programs connected to the circuit board, a switch connected to the control unit, and a plurality of batteries connected to the circuit board such that the control unit will make said light emitting elements flash on and off repeatedly in respective manners when the switch is pressed to turn on the shining mechanism.

3. The flash adornment structure as recited in claim 1, wherein the transparent protective cover has a plurality of propping posts on an edge of an inward side thereof, which are pressed against the circuit board.

4. The flash adornment structure as recited in claim 1, wherein the transparent protective cover has a layer of drawing thereon.

5. The flash adornment structure as recited in claim 1, wherein the circuit board is coated with reflecting agents on said first side thereof, on which the light emitting elements are positioned.

6. The flash adornment structure as recited in claim 1, wherein the base has a battery holding portion adjacent to a bottom of the holding room thereof, a battery covering secured over the battery holding portion, and an electricity conducting plate secured on an inner side of the battery covering and electrically connected to the batteries.

7. The flash adornment structure as recited in claim 6, wherein the base has an opening on a circumferential side thereof such that an insulating plate is removably insertable between the batteries and the electricity conducting plate through the opening to prevent electrical contact between the batteries and the electricity conducting plate.

8. The flash adornment structure as recited in claim 1, wherein a hanging string is connected to the base.

9. A flash adornment structure, comprising:

(a) a base, the base has a holding room therein, a plurality of connecting holes near to an edge of a lower portion of the holding room, a battery holding portion adjacent to the lower portion of the holding room, a battery covering secured over the battery holding portion, and an electricity conducting plate secured on an inner side of the battery covering being electrically connected to the batteries;

(b) a shining mechanism held in the holding room of the base, the shining mechanism including:

a circuit board, the circuit board having a plurality of through holes near to an edge thereof; said through holes facing respective ones of the connecting holes of the base; and a plurality of light emitting elements on a first side of the circuit board;

(c) an upper lid secured over the base, the upper lid having a hollowness; the upper lid having a plurality of spaced apart fixing parts and a plurality of post parts on an edge of an inner side thereof; each of the fixing parts having a fitting room therein, which holds a respective one of the light emitting elements; each of the post parts having a hole; the post parts being passed through respective ones of the through holes of the circuit board; screws being passed through the connecting holes of the base and into the holes of the post parts to secure the base to the upper lid; and (d) a transparent protective cover secured over the hollowness of the upper lid, wherein the base has an opening on a circumferential side thereof such that an insulating plate is removably insertable between the batteries and the electricity conducting plate through the opening to prevent electrical contact between the batteries and the electricity conducting plate.

10. The flash adornment structure as recited in claim 9, wherein the shining mechanism has a control unit containing programs connected to the circuit board, a switch connected to the control unit, and a plurality of batteries connected to the circuit board such that the control unit will make said light emitting elements flash on and off repeatedly in respective manners when the switch is pressed to turn on the shining mechanism.

11. The flash adornment structure as recited in claim 9, wherein the transparent protective cover has a plurality of spaced apart gaps on an edge thereof, in which the fixing parts of the upper lid are fitted.

12. The flash adornment structure as recited in claim 9, wherein the transparent protective cover has a plurality of propping posts on an edge of an inward side thereof, which are pressed against the circuit board.

13. The flash adornment structure as recited in claim 9, wherein the transparent protective cover has a layer of drawing thereon.

14. The flash adornment structure as recited in claim 9, wherein the circuit board is coated with reflecting agents on said first side thereof, on which the light emitting elements are positioned.

15. The flash adornment structure as recited in claim 9, wherein a hanging string is connected to the base.

* * * * *